US006492767B1

(12) United States Patent
Bae

(10) Patent No.: US 6,492,767 B1
(45) Date of Patent: Dec. 10, 2002

(54) ELECTRON GUN FOR COLOR CATHODE RAY TUBE

(75) Inventor: Min-cheol Bae, Suwon (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/551,698

(22) Filed: Apr. 18, 2000

(30) Foreign Application Priority Data

Apr. 19, 1999 (KR) ..... 99-13803

(51) Int. Cl.[7] ..... H01J 29/58

(52) U.S. Cl. ..... 313/414; 313/449; 315/382; 315/15

(58) Field of Search ..... 313/414, 412, 313/427, 452, 460, 428; 315/382

(56) References Cited

U.S. PATENT DOCUMENTS 5,036,258 A * 7/1991 Chen et al. ..... 313/414
5,652,475 A * 7/1997 Lee ..... 313/414
6,172,450 B1 * 1/2001 Natori et al. ..... 313/414

* cited by examiner

*Primary Examiner*—Vip Patel
*Assistant Examiner*—Ken A Berck
(74) *Attorney, Agent, or Firm*—Lowe Hauptman Gilman & Berner, LLP

(57) ABSTRACT

An electron gun for a color cathode ray tube includes a first electrode, a second electrode and a third electrode. A waveform alternating voltage or a static voltage is applied to the first electrode in which three vertical slot type electron beam passing holes are formed. The second electrode is installed at one side of the first electrode in which circular electron beam passing holes are formed. The third electrode is disposed at the other side of the first electrode. A single horizontal slot type electron beam passing hole is formed in the third electrode to which the same dynamic focus voltage as that in the second electrode is applied.

18 Claims, 3 Drawing Sheets

ELECTRON GUN FOR COLOR CATHODE RAY TUBE

BACKGROUND OF THE INVENTION

1. Field of the Invention

The present invention relates to an electron gun for a color cathode ray tube, and more particularly, to a dynamic focus electron gun for a color cathode ray tube having improved electron beam passing holes aligned in-line and forming a quadrupole lens.

2. Description of the Related Art

In general, an electron gun for a color cathode ray tube (CRT) is installed at a neck portion of a CRT for emitting electron beam. The performance of a CRT is determined by a state in which an electron beam emitted from the electron gun lands on a fluorescent film. Thus, many electron guns have been developer which can improve a focus feature and reduce aberration of an electron lens so that the electron beam emitted from the electron gun accurately lands on a fluorescent point of the fluorescent film.

As an example of the electron gun, electron beam passing holes of a vertical slot type and electron beam passing holes in a horizontal slot type for forming a quadrupole lens at an exhaust surface of a focus electrode and an incident surface thereof facing each other, respectively. A blade inserted into the electron beam passing holes formed at the exhaust surface of the focus lens disposed at a cathode's side, is formed at the upper and lower sides of the electron beam passing holes formed at the incident surface of the focus lens.

In the electron gun for a color CRT having the above structure, in forming the quadrupole lens, as a vertical focusing force becomes weak by the electron beam passing holes in a horizontal slot type formed at the exhaust surface of the focus electrode, a dynamic voltage needs to be applied to an electrode. Also, in forming another quadrupole lens, as the blade is formed at the upper and lower sides of the electron beam passing holes of the electrode, the manufacture of electrodes is difficult and distribution between electrodes is not regular.

Another example of the conventional electron gun for a CRT is disclosed in U.S. Pat. No. 5,036,285. The electron gun includes first and third electrodes having holes, through which electron beams pass, formed in a keyhole shape in a horizontal direction for each of the beams, and a second electrode interposed between the first and third electrodes and having holes formed in a keyhole shape in a vertical direction for each of the electron beams. A dynamic focus voltage is applied to the first and third electrodes and a constant voltage is applied to the second electrode.

In the electron gun for a color CRT having the above-mentioned structure, an electron lens is formed between the first, second and third electrodes as the dynamic focus voltage and the constant voltage are applied to the first and third electrodes and the second electrode, respectively, so that a focus feature and a convergence feature are improved and the profile of an electron beam is corrected. However, the above electron gun exhibits high sensitivity because the quadrupole lens is too intensive and the adjustment of a voltage is difficult because the shape of a beam varies too much. Also, each of the electron beam passing holes formed in the electrodes forming a quadrupole is not circular and, as the electron beam passing holes overlap many times, distortion of the electron beam which is not preferred prevails and assembly thereof is not easy. Accordingly, the degree of alignment according to the assembly of electrode deteriorates.

SUMMARY OF THE INVENTION

To solve the above problems, it is an objective of the present invention to provide an electron gun for a color CRT which can reduce the distortion of the profile of an electron beam passing an electron lens by adopting as few circular passing holes as possible, and improving a focus feature by forming a quadrupole lens having an appropriate lens multiplier.

Accordingly, to achieve the above objective, there is provided an electron gun for a color cathode ray tube which comprises a first electrode to which a waveform alternating voltage or a static voltage is applied and where three vertical slot type electron beam passing holes are formed, a second electrode installed at one side of the first electrode, where circular electron beam passing holes are formed, and a third electrode disposed at the other side of the first electrode, where a single horizontal slot type electron beam passing hole is formed and to which the same dynamic focus voltage as that in the second electrode is applied.

According to another aspect of the present invention, there is provided an electron gun for a color cathode ray tube which comprises a first electrode to which a waveform alternating voltage or a static voltage is applied and where three circular electron beam passing holes are formed, a second electrode installed at one side of the first electrode, where horizontal slot type electron beam passing holes are formed, and a third electrode disposed at the other side of the first electrode, where circular type electron beam passing holes are formed and to which the same dynamic focus voltage as that in the second electrode is applied.

According to yet another aspect of the present invention, there is provided an electron gun for a color cathode ray tube which comprises a first electrode to which a waveform alternating voltage or a static voltage is applied and where three vertical slot type electron beam passing holes are formed, a second electrode installed at one side of the first electrode, where horizontal slot type electron beam passing holes are formed, and a third electrode disposed at the other side of the first electrode, where circular electron beam passing holes are formed and to which the same dynamic focus voltage as that in the second electrode is applied.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

An electron gun for a color CRT according to the present invention includes a triode portion formed by a cathode, a control electrode and a screen electrode, and a plurality of electrodes forming an electron lens including a quadrupole lens for focusing and accelerating an electron beam. In the above electron gun, when the effect of the quadrupole lens formed by the electrodes is increased, a dynamic parabola peak value voltage applied in synchronization with a deflection signal is lowered while a dynamic parabola voltage having a high peak value is required when the effect of the quadrupole lens is low. However, when a voltage at a level of a parabola voltage of about 350 volts commonly used for a driving circuit is applied, an appropriate quadrupole effect is obtained and an optimal focus feature is available. The absolute intensity of the quadrupole varies according to the structure, the connection, the driving method and the occupation area, when an electron beam passes the quadrupole lens, of the electron gun. The preferred embodiments below are formed by a quadrupole lens exhibiting small aberration in the electron beam.

Figure 1:
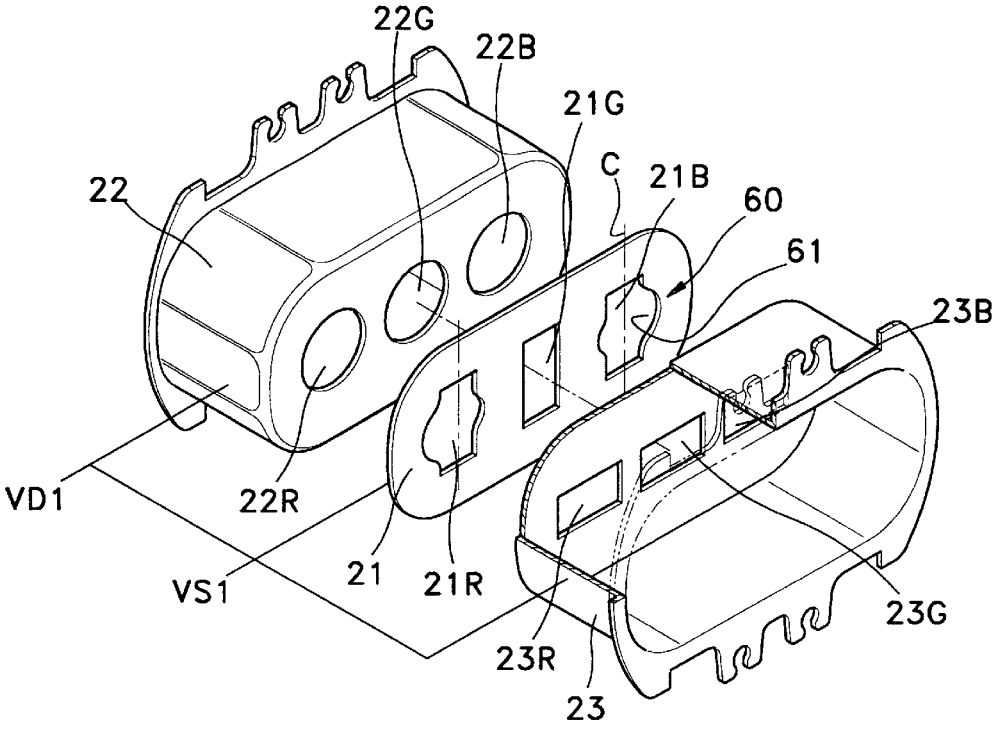
FIG. 1 is a perspective view showing electrodes forming a quadrupole lens in an electron gun for a color CRT according to the present invention.
Figure 2:
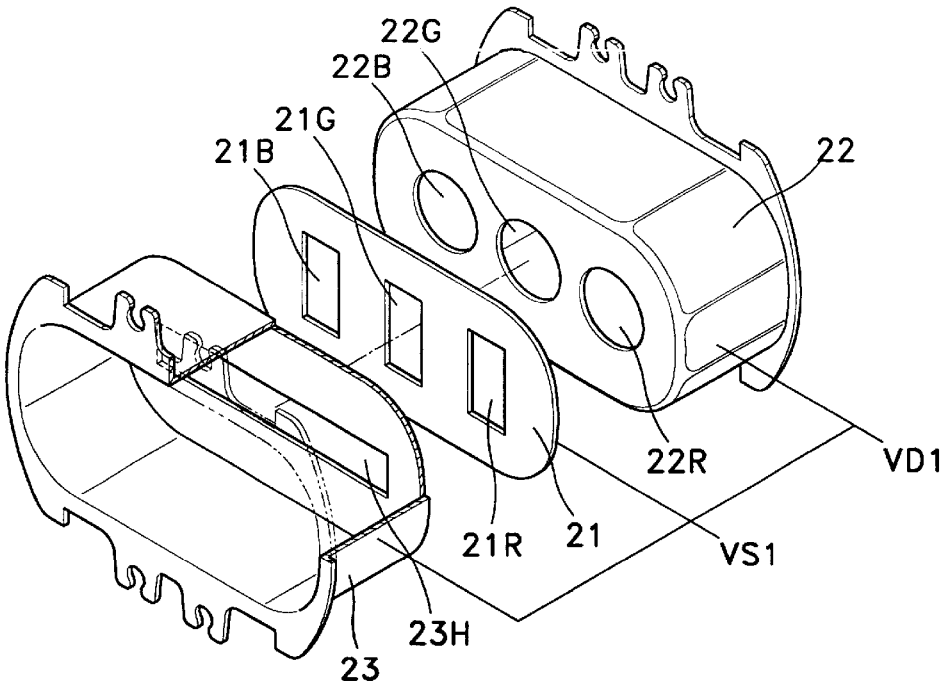
FIGS. 2 through 5 are views showing electrodes forming a quadrupole lens in an electron gun for a color CRT according to other preferred embodiments of the present invention
Figure 3:
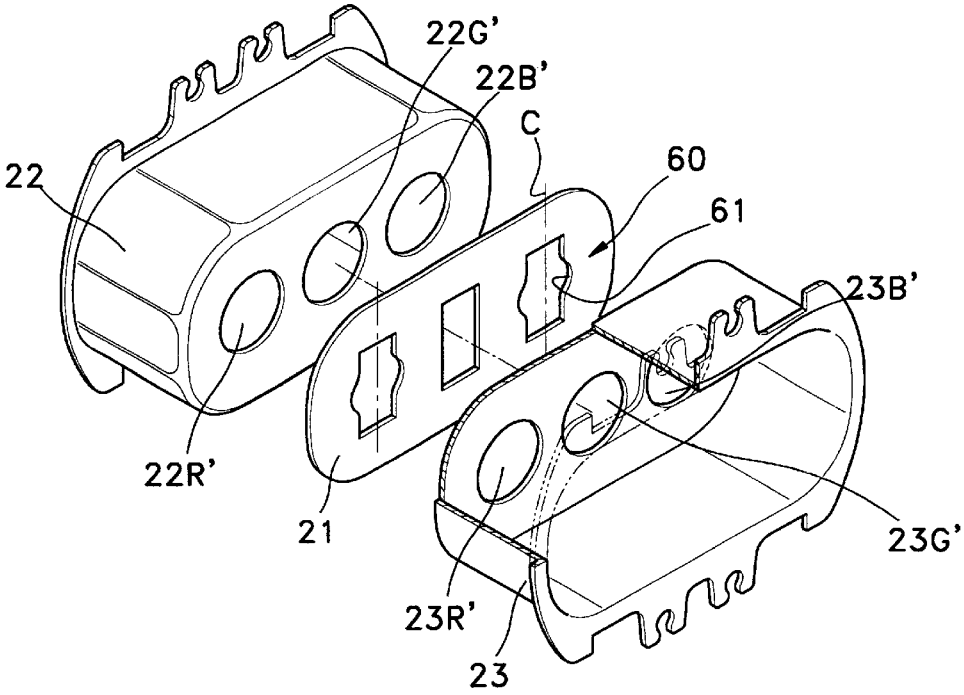
Figure 4:
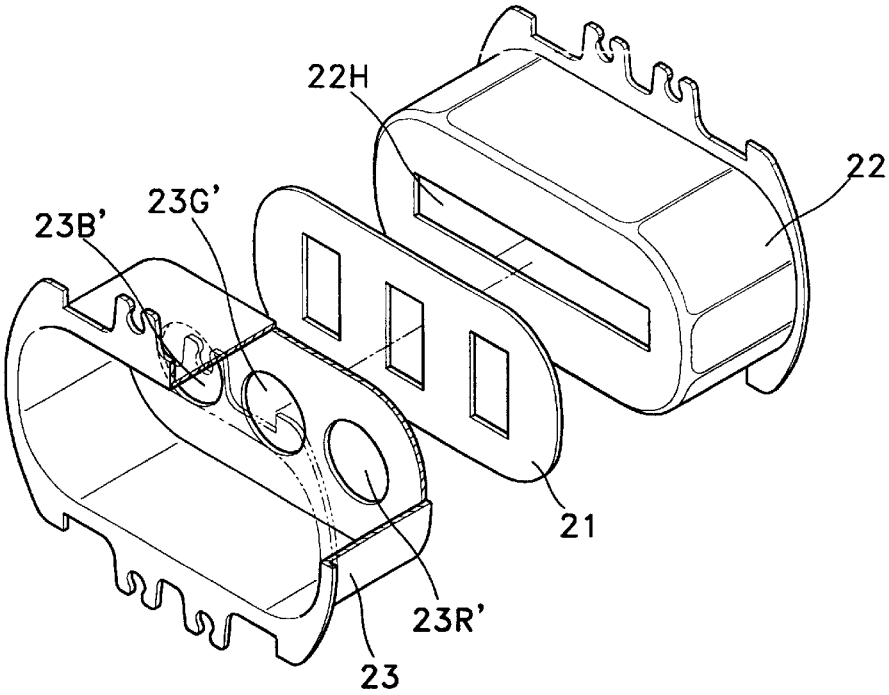

FIG. 1 shows electrodes installed coaxially with the triode portion for forming an electron lens and a state in which a voltage is applied. As shown in the drawing, a device for forming an electron lens according to the present invention includes a first electrode 21 where three in-line vertical slot type electron beam passing holes 21R, 21G and 21B are formed, a second electrode 22 installed at one side of the first electrode 21, that is, near a cathode (not shown) of the electron gun, where three in-line circular electron beam passing holes 22R, 22G and 22B are formed, and a third electrode 23 installed at the other side of the first electrode 21 where three horizontal slot type electron beam passing holes 23R, 23G and 23B are formed. The electron beam passing holes formed in the third electrode 23, as shown in FIG. 2, can be a single horizontal slot type electron beam passing hole 23H. Here, the second and third electrodes 22 and 23 can have circular electron beam passing holes 22R', 22G' and 22B', and 23R', 23G' and 23B', as shown in FIG. 3. Also, as shown in FIG. 4, in the second electrode 22, a single horizontal slot type electron beam passing hole 22H can be formed and circular electron beam passing holes 23R', 23G' and 23B' can be formed. Here, the three vertical slot type electron beam passing holes or the three horizontal slot type electron beam passing holes can be formed to have a keyhole shape.

Also, a predetermined voltage is applied to each electrode. That is, a dynamic focus voltage VD1 in synchronization with a deflection signal is applied to the second and third electrodes 22 and 23 and a waveform alternating voltage or static voltage VS1 which is higher or lower than the VD1 is applied to the first electrode 21.

Figure 5:
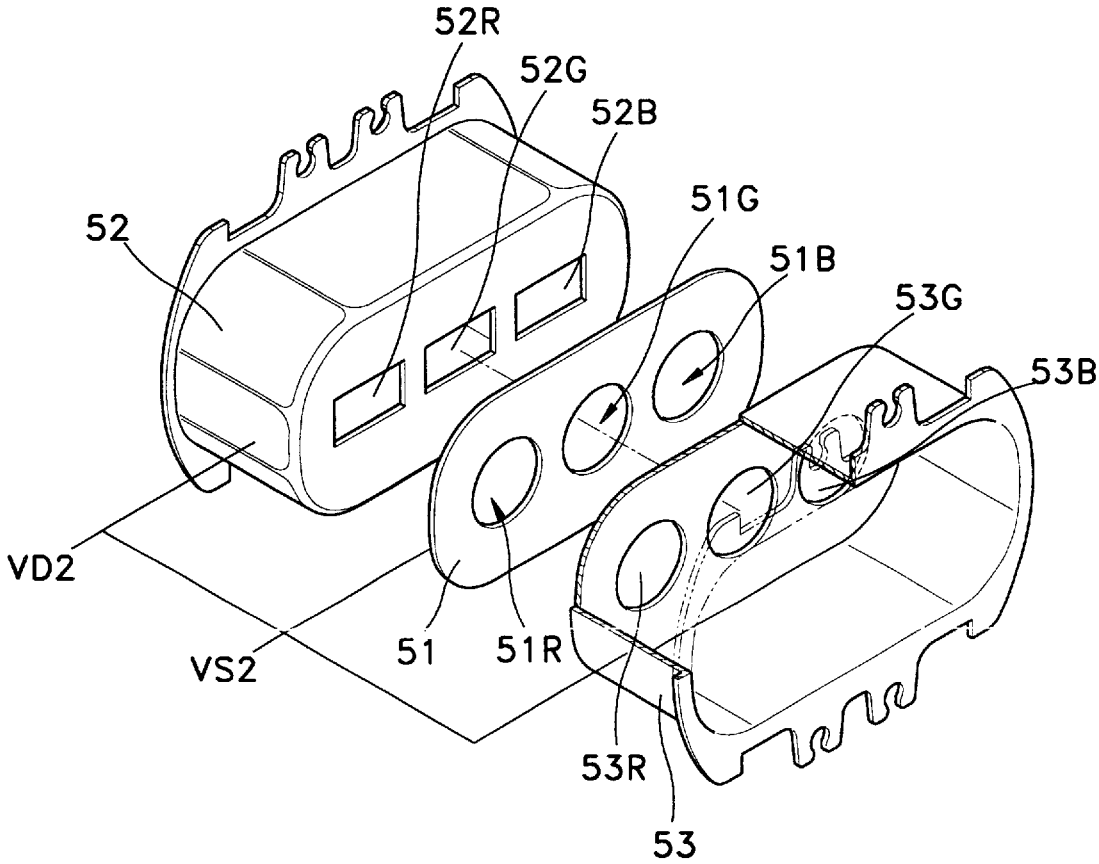

Another preferred embodiment of the device forming an electron lens for focusing and diverging an electron beam according to the present invention is shown in FIG. 5. The device includes a first electrode 51 where three in-line circular electron beam passing holes 51R, 51G and 51B are formed, a second electrode 52 installed at one side of the first electrode 51, that is, near a cathode (not shown) of the electron gun, where three in-line horizontal slot type electron beam passing holes 52R, 52G and 52B are formed, and a third electrode 53 installed at the other side of the first electrode 51 where three circular electron beam passing holes 53R, 53G and 53B are formed.

Also, a waveform alternating voltage or static voltage VS2 which is higher or lower than a dynamic focus voltage which is described later is applied by the predetermined voltage supply device to the first electrode 51. A parabola type dynamic focus voltage VD2 in synchronization with a deflection signal is applied to the second and third electrodes 52 and 53.

In the above-described preferred embodiments, a convergence adjustment device 60 for converging the electron beams passing through the electron beam passing holes 21R, 21B, 51R and 51B toward the electron beam passing through the electron beam passing holes 21G and 51G disposed at the central portion of the electron beam passing holes is further provided at the electron beam passing holes 21R, 21B, 51R and 51B disposed at both sides of the electron beam passing holes 21G and 51G respectively formed in the first electrodes 21 and 51. The convergence adjustment device 60 is of a vertical slot type and the electron beam passing holes 21R, 21B, 51R and 51B disposed at both sides of the electron beam passing holes 21G and 51G are formed to be asymmetrical with respect to a vertical axis C passing the center thereof. For example, in the convergence adjustment device 60, an indented portion is formed at the inner or outer side of each of the electron beam passing holes 21R, 21B, 51R and 51B at both sides of the first electrodes 21 and 51, that is, at the inner or outer side in a direction perpendicular to the vertical axis C. The indented portion 61 can be semicircular, semi-oval or a part of a polygon. The electron beam passing holes 21R and 21B positioned at both sides of the three electron beam passing holes 21R, 21G and 21B formed on the first electrode 21 can be eccentric with respect to the center of the electron beam passing holes 22R, 22B and 23R, 23B at both sides of each of the second and third electrodes 22 and 23. In the case in which a circular electron beam passing holes 51R, 51G and 51B are formed on the first electrode 51, the diameter of the electron beam passing hole 51G disposed at the center of the three electron beam passing holes 21R, 21G and 21B may be formed different from those of the electron beam passing holes 51R and 51B disposed at the peripheral portion thereof.

In the operation of the electron gun for a color CRT according to the present invention having the above structure, the electron gun includes a triode portion formed by a cathode, a control electrode and a screen electrode, first, second and third electrodes sequentially installed to be coaxial with the triode portion as an electron lens device for focusing and accelerating an electron beam, and a final acceleration electrode installed to be adjacent to the third electrode.

When a predetermined voltage is applied to each electrode, a pre-focus lens is formed between the screen electrode and the first electrode. A quadrupole lens is formed at the first, second and third electrodes according to the application of a dynamic focus voltage. A main lens is formed between the third electrode and the final acceleration electrode.

In the electron lenses formed between the electrodes, the intensity and the lens formation state of an electron lens, and a focusing state of an electron beam vary according to the position of the electron beam landing on a fluorescent film. The above states will be described below according to a state in which the electron beam is scanned on the central portion of the fluorescent film and a state in which the electron beam is scanned on the periphery of the fluorescent film.

When the electron beam is scanned on the central portion of the fluorescent film, a dynamic focus voltage in synchronization with a deflection signal is not applied to the second and third focus electrodes 22 and 23 and a constant voltage is applied to the first electrode 21. Thus, an electron lens is formed between the first, second and third electrodes 21, 22 and 23 due to the difference between the constant voltage VS1 and the minimum dynamic focus voltage. A main lens is formed between the third electrode and the final acceleration electrode. An electron beam emitted from the cathode is focused and accelerated while passing through the electron lens and focused and accelerated by the main lens, and then lands on the central portion of a screen.

When the electron beam emitted from the electron gun is scanned on the periphery of the fluorescent film, a dynamic focus voltage VD1 or VD2 in synchronization with a deflection signal is applied to the first and third electrodes 21 and 23. Thus, an asymmetric electron lens having a different focusing force in the vertical direction and the horizontal direction by the vertical slot type electron beam passing holes 21R, 21G and 21B formed in the first electrode 21 and the circular electron beam passing holes 22R, 22G and 22B and the horizontal slot type electron beam passing holes 23R, 23G and 23B formed in the second and third electrodes 22 and 23, respectively, is formed between the first, second and third electrodes 21, 22 and 23. In particular, as an indented portion is formed at the edge of both sides or inner side of the vertical slot type electron beam passing holes 21R and 21B disposed at both sides of the first electrode 21, the electron lens formed by the electron beam passing holes 21R and 21B at both sides is formed to be asymmetrical with respect to the vertical axis C.

Thus, the profile of the electron beam passing through the above electron beam passing holes forms a vertical slot type so that distortion of an electron beam due to irregular magnetic field by a deflection yoke is compensated for and the electron beams passing through the electron beam passing holes 21R and 21B at both sides thereof are converged toward the central electron beam. Thus, the distortion of an electron beam spot landing on a fluorescent film can be compensated for and a focus feature can be improved.

As described above, in the electron gun for a color CRT according to the present invention, an intense quadrupole lens can be formed using three electrodes and, as the electron beam passing holes are formed to be of a horizontal slot type, a vertical slot type or circular type, a dynamic focus voltage can be reduced. Also, as electrodes overlap, in which non-circular electron beam passing holes for forming the quadrupole lens are formed, the undesirable distortion of an electron beam can be minimized. When the electron gun is assembled, the difficulty in maintaining the degree of alignment of the electron gun due to non-circular type electrodes is improved so that distribution of assembly and manufacture cost can be reduced.

In particular, as distortion due to a deflection magnetic field due to the deflection of the electron beam can be reduced, the regular electron beam profile can be formed on the overall fluorescent surface.

It is noted that the present invention is not limited to the preferred embodiment described above, and it is apparent that variations and modifications by those skilled in the art can be effected within the spirit and scope of the present invention defined in the appended claims.

What is claimed is:

1. An electron gun for a color cathode ray tube, comprising:

a first electrode, to which a waveform alternating voltage or a static voltage is applied, said first electrode having three vertical slot type electron beam passing holes; and second and third electrodes, which are installed at opposite sides of said first electrode and to which a dynamic focus voltage is applied, said second electrode having three circular electron beam passing holes whereas said third electrode having a single horizontal slot type electron beam passing hole;

wherein the waveform alternating voltage or static voltage applied to the first electrode is higher or lower than the dynamic focus voltage applied to the second and third electrodes.

2. An electron gun for a color cathode ray tube, comprising:

a first electrode, to which a waveform alternating voltage or a static voltage is applied, said first electrode having three circular electron beam passing holes; and second and third electrodes, which are installed at opposite sides of said first electrode and to which a dynamic focus voltage is applied, said second electrode having three horizontal slot type electron beam passing holes whereas said third electrode having three circular electron beam passing holes;

wherein the waveform alternating voltage or static voltage applied to the first electrode is higher or lower than the dynamic focus voltage applied to the second and third electrodes.

3. An electron gun for a color cathode ray tube, comprising:

a first electrode, to which a waveform alternating voltage or a static voltage is applied, said first electrode having three vertical slot type electron beam passing holes; and second and third electrodes, which are installed at opposite sides of said first electrode and to which a dynamic focus voltage is applied, said second electrode having three horizontal slot type electron beam passing holes whereas said third electrode having three circular electron beam passing holes;

wherein the waveform alternating voltage or static voltage applied to the first electrode is higher or lower than the dynamic focus voltage applied to the second and third electrodes.

4. The electron gun of claim 1, wherein the vertical slot type electron beam passing holes of said first electrode comprise a vertically elongated central hole and two vertically elongated lateral holes disposed at opposite sides of the vertically elongated central hole;

the circular electron beam passing holes of said second electrode comprise a circular central hole and two circular lateral holes disposed at opposite sides of the circular central hole; and the single horizontal slot type electron beam passing hole of said third electrode comprises a horizontally elongated hole disposed in alignment with the vertically elongated holes of said first electrode which, in turn, are in alignment with the circular holes of said second electrode, respectively.

5. The electron gun of claim 4, wherein centers of the lateral holes of said first electrode are offset with respect to centers of the respective lateral holes of said second electrode so that, during operation of said electron gun, electron beams passing through the lateral holes are converged towards the central holes.

6. The electron gun of claim 5, wherein the waveform alternating voltage or static voltage applied to the first electrode is higher than the dynamic focus voltage applied to the second and third electrodes.

7. The electron gun of claim 5, wherein the waveform alternating voltage or static voltage applied to the first electrode is lower than the dynamic focus voltage applied to the second and third electrodes.

8. The electron gun of claim 2, wherein the circular electron beam passing holes of said first electrode comprise a circular central hole and two circular lateral holes disposed at opposite sides of the circular central hole;

the horizontal slot type electron beam passing holes of said second electrode comprise a horizontally elongated central hole and two horizontally elongated lateral holes disposed at opposite sides of the horizontally elongated central hole;

the circular electron beam passing holes of said third electrode comprise a circular central hole and two circular lateral holes disposed at opposite sides of the circular central hole; and the central and lateral holes of said first, second, and third electrodes are disposed in alignment with each other, respectively.

9. The electron gun as claimed in claim 8, wherein, in said first electrode, a diameter of the central hole is different from those of the lateral holes.

10. The electron gun as claimed in claim 8, wherein centers of the lateral holes of said first electrode are offset with respect to centers of the respective lateral holes of said second and third electrodes so that, during operation of said electron gun, electron beams passing through the lateral holes are converged towards the central holes.

11. The electron gun of claim 9, wherein the waveform alternating voltage or static voltage applied to the first electrode is higher than the dynamic focus voltage applied to the second and third electrodes.

12. The electron gun of claim 9, wherein the waveform alternating voltage or static voltage applied to the first electrode is lower than the dynamic focus voltage applied to the second and third electrodes.

13. The electron gun of claim 3, wherein the vertical slot type electron beam passing holes of said first electrode comprise a vertically elongated central hole and two vertically elongated lateral holes disposed at opposite sides of the vertically elongated central hole;

the horizontal slot type electron beam passing holes of said second electrode comprise a horizontally elongated central hole and two horizontally elongated lateral holes disposed at opposite sides of the horizontally elongated central hole;

the circular electron beam passing holes of said third electrode comprise a circular central hole and two circular lateral holes disposed at opposite sides of the circular central hole; and the central and lateral holes of said first, second, and third electrodes are disposed in alignment with each other, respectively.

14. The electron gun of claim 13, wherein each of the lateral holes of said first electrode is formed to be asymmetric with respect to a vertical plane containing centers of the respective lateral holes of said second and third electrodes so that, during operation of said electron gun, electron beams passing through the lateral holes are converged towards the central holes.

15. The electron gun of claim 14, wherein each of the lateral asymmetric holes of said first electrode includes a middle generally rectangular section and two indent sections extending laterally from the middle rectangular section, a lateral extension of the indent section which extends away from the central hole of said first electrode is longer than that of the other indent section which extends towards said central hole.

16. The electron gun of claim 15, wherein each of the indent sections has one of semicircular, semi-oval, and polygonal shapes.

17. The electron gun of claim 15, wherein the waveform alternating voltage or static voltage applied to the first electrode is higher than the dynamic focus voltage applied to the second and third electrodes.

18. The electron gun of claim 15, wherein the waveform alternating voltage or static voltage applied to the first electrode is lower than the dynamic focus voltage applied to the second and third electrodes.

* * * * *